US005103751A

United States Patent [19]

Wang

[11] Patent Number: 5,103,751

[45] Date of Patent: Apr. 14, 1992

[54] DIFFERENTIAL FEEDING APPARATUS FOR A SEWING MACHINE

[76] Inventor: Shui-Nu Wang, No. 6, Nan Pin Road, Taichung, Taiwan

[21] Appl. No.: 743,714

[22] Filed: Aug. 12, 1991

Related U.S. Application Data

[62] Division of Ser. No. 654,244, Feb. 12, 1991, Pat. No. 5,069,152.

[51] Int. Cl.[5] ..... D05B 27/00

[52] U.S. Cl. ..... 112/314

[58] Field of Search ..... 112/303, 312, 313, 314

[56] References Cited

U.S. PATENT DOCUMENTS

| | | | |
|---|---|---|---|
| 2,771,848 | 11/1956 | Knaus et al. | 112/313 |
| 3,450,079 | 6/1969 | Lukin | 112/313 |
| 3,611,817 | 10/1971 | Smith et al. | 112/313 |
| 4,295,434 | 10/1981 | Hsiao | 112/314 |
| 4,436,045 | 3/1984 | Bonham et al. | 112/313 |
| 4,674,426 | 6/1987 | Kasuda et al. | 112/313 |

*Primary Examiner*—Werner H. Schroeder
*Assistant Examiner*—Paul C. Lewis

[57] ABSTRACT

A feeding apparatus includes a spindle and a shaft disposed in a base of a sewing machine. A lever is fixed on the shaft and can be caused to swing by the spindle. Two followers are engaged on the spindle. A pawl is fixed on each follower for feeding cloth. One follower is coupled to one end of the lever and the other follower is coupled to the other end of the lever by a link and a lever arm. The amplitude of swinging of the lever arm can be changed so that one of the pawls can be caused to move back and forth relative to the other pawl.

2 Claims, 6 Drawing Sheets

DIFFERENTIAL FEEDING APPARATUS FOR A SEWING MACHINE

This a division, of application Ser. No. 654,244, filed Feb. 12, 1991 now U.S. Pat. No. 5,069,152.

BACKGROUND OF THE INVENTION (a) Field of the Invention

The present invention relates to a feeding apparatus, and more particularly to a differential feeding apparatus for a sewing machine.

(b) Description of the Prior Art

A feeding apparatus is generally provided in a sewing machine for feeding forward a cloth which is to be sewed by the sewing machine. The cloth is generally fed forward smoothly and flatly. However, when it is required to form wrinkles in the cloth, it is usually first required to form wrinkle portions manually in the cloth and then the wrinkle portions should be carefully handled and pressed by hands during sewing operations so that the wrinkles can be formed. The sewing operations are difficult and time consuming. In addition, when it is required to sew or to stitch elastic cloth or elastic article, such as an elastic band, it is usually first required to stretch and to protract the elastic article manually and then maintain the stretch status during sewing operations so that the elastic article can be sewed. The sewing operations are also difficult and very inconvenient.

The present invention has arisen to mitigate and/or obviate the afore-described disadvantages of the conventional sewing machines.

SUMMARY OF THE INVENTION

The primary object of the present invention is to provide a differential feeding apparatus for a sewing machine in which the cloth can be fed differentially so that wrinkles can be easily formed in the cloth and so that elastic articles can be easily sewed.

In accordance with one aspect of the present invention, there is provided a differential feeding apparatus which is disposed in a base of a sewing machine and which includes a shaft caused to swing by a spindle. A lever is fixed on the shaft. A cam is fixed on the spindle and is engaged in two followers for causing the followers to move up and down. A pawl is fixed on each of the follower. One of the followers is pivotally coupled to one end of the level so that the follower is caused to move back and forth by swinging movement of the lever. One end of a link is pivotally coupled to the other end of the lever. The other end of the link has a block slidably received in a groove formed in a lower portion of a second lever. The other follower is coupled to the upper end of the second lever so that the other follower can be caused to move back and forth by swinging movement of the second lever. When the block is caused to move up and down along the groove of the second lever, the distance between the block and the pivoty axle of the second lever can be changed so that the amplitude of the upper end of the second lever can be adjusted and so that one pawl can be caused to move back and forth relative to the other pawl.

Further objectives and advantages of the present invention will become apparent from a careful reading of the detailed description provided hereinbelow, with appropriate reference to the accompanying drawings.

BRIEF DESCRIPION OF THE DRAWINGS

DETAILED DESCRIPTION OF THE INVENTION

Figure 1:
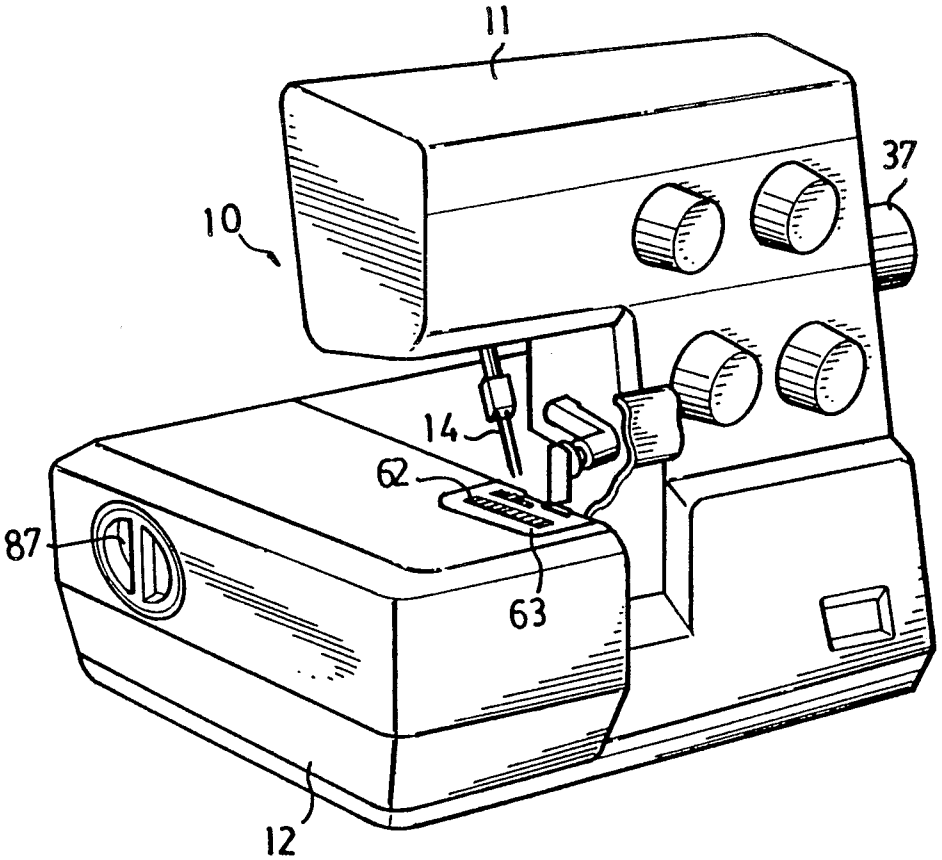
FIG. 1 is a perspective view of a sewing machine.

Referring to the drawings and initially to FIG. 1, a sewing machine 10 generally comprises a cantilever beam 11 disposed on a base 12 and a needle 14 provided at the free end portion of the cantilever beam 11 for conducting sewing operations. A differential feeding apparatus in accordance with the present invention is disposed in the sewing machine 10 for feeding the cloth to be sewed differentially.

Figure 2:
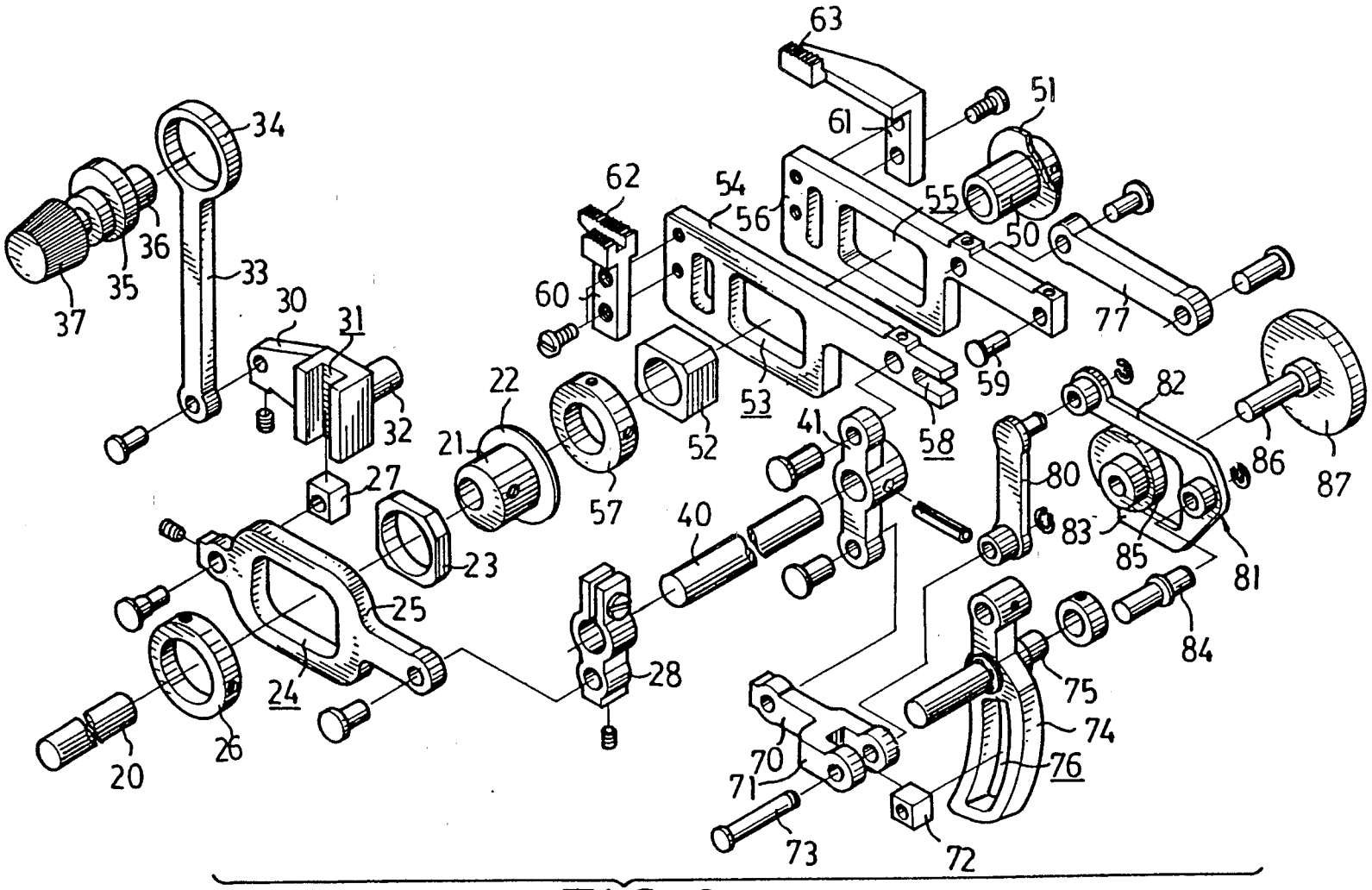
FIG. 2 is an exploded view of the differential feeding apparatus in accordance with the present invention.
Figure 3:
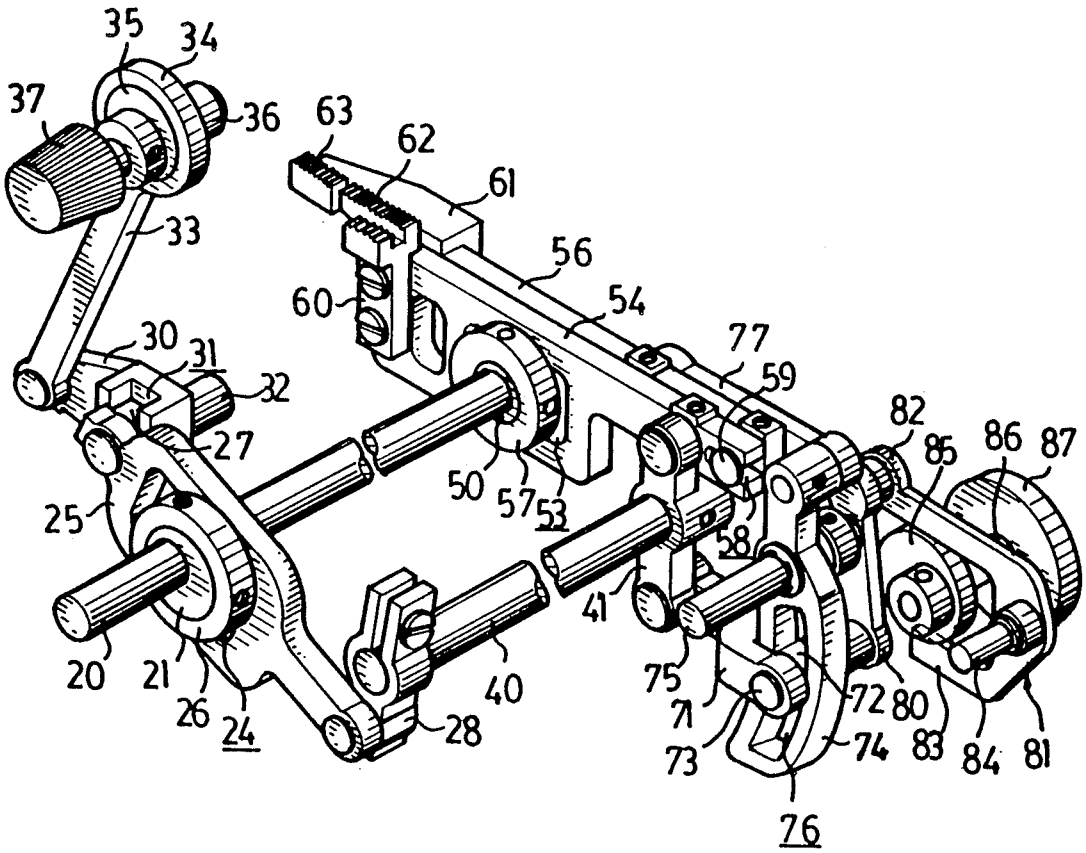
FIG. 3 is a perspective view of the differential feeding apparatus.

Referring nexy to FIGS. 2 and 3, the differential feeding apparatus comprises generally a driving spindle 20 and a shaft 40 rotatably supported in parallel in the base 12 of the sewing machine 10. A cam 21 is fixed on one end of the driving spindle 20 and rotates in concert with the driving spindle 20. An annular flange 22 is integrally formed on one end of the cam 21. A guide 23 which has a substantially square outer shape is rotatably engaged on the cam 21 and is slidably received in a rectangular opening 24 of a follower 25. A ring 26 is fixed on the other end of the cam 21 so that the guide 23 is guided to slide along the rectangular opening 24 of the follower 25 and so that the follower 25 can be caused to move relatively up and down by rotation of the cam 21 and the spindle 20.

A block 27 is pivotally coupled to one end of the follower 25, and the other end of the follower 25 is pivotally coupled to a lower end of a lever 28 which has a middle portion fixed to one end of the shaft 40, The lever 28 can be caused to swing about the axis of the shaft 40 by the follower 25. A middle portion of another lever 41 is fixed on the other end of the shaft 40. The block 27 is guided to slide along a slot 31 formed in one end of a plate 30, this end of the plate 30 is pivotally supported in the base 12 of the machine 10 by a stub 32. The other end of the plate 30 is pivotally coupled to a lower end of an arm 33 which has a ring portion 34 formed on the upper end thereof. A cam 35 is fixed on an axle 36 which is rotatably supported in the base 12 of the machine 10, and is received in the ring portion 34 in a sliding engagement so that the arm 33 can be caused to move up and down by rotation of the cam 35 and the axle 36. The plate 30 is thus caused to rotate about the stub 32 so that the longitudinal axis 38 (FIGS. 4 and 5) of the slot 31 is also caused to rotate about the stub 32. A knob 37 is fixed on one end of the axle 36 and is located outside of the base 12 (FIg. 1).

A cam 50 is fixed on the other end of the driving spindle 120 opposite to the cam 21 and rotates in concert with the driving spindle 20. An annular flange 51 is integrally formed on one end of the cam 50. A guide 52 which has a substantially square outer shape is rotatably engaged on the cam 50 and is slidably received in both rectangular openings 53, 55 of two followers 54, 56. A ring 57 is fixed on the other end of the cam 50 so that the guide 52 is guided to slide along the rectangular openings 53, 55 of the followers 54, 56 and so that both followers 54, 56 can be caused to move up and down simultaneously by rotation of the cam 50 and the spindle 20. A notch 58 is formed in a rear end of the follower 54. A pin 59 is fixed to a rear end of the follower 56 and is slidably received in the notch 58 of the follower 54 so that the followers 54 and 56 can be guided to move forward and backward relative to each other by the sliding engagements between the guide 52 and the openings 53, 55 and between the pin 59 and the notch 58.

A support 60, 61 is fixed to the front end of each of the followers 54, 56. A pawl 62, 63 is formed on the upper end of each of the supports 60, 61. The pawls 62, 63 are aligned so that the pawls 62, 63 can be caused to move forward and backward relative to each other when the followers 54, 56 move forward and backward relative to each other. The upper end of the lever 41 is pivotally coupled to the rear end of the follower 54 so that the follower 54 can be caused to move back and forth by the swinging movement of the lever 41.

Figure 5:
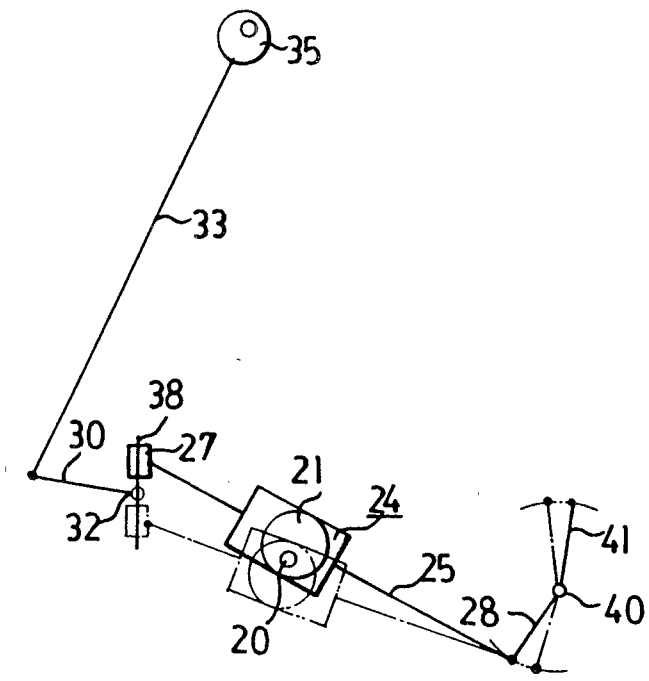
FIGS. 4 and 5 are schematic views illustrating the adjustement of a feeding stroke of the differential feeding apparatus.
Figure 4:
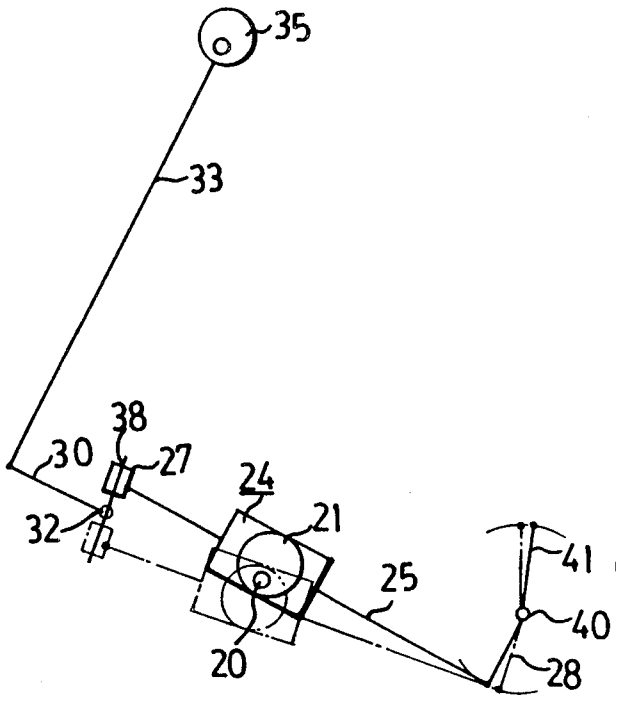

Referring next to FIGS. 4 and 5, when the arm 33 is caused to move up and down by the cam 35 so that the longitudinal axis 38 of the slot 31 is also caused to rotate about the axis of the stub 32, and when the middle portion of the follower 25 is caused to move up and down by the cam 21, the amplitude of swinging of the lever 28 can be changed so that the amplitude of swinging of the lever 41 can also be changed. The amplitude of swinging of the lever 41 is related to the displacement of the pawls 62, 63 which is related to the feeding stroke of the feeding apparatus.

Referring again to FIGS. 2 and 3, the front end of a link 70 is pivotally coupled to the lower end of the lever 41. A fork 71 is integrally formed on the rear end of the link 70. A block 72 is pivotally supported between the limbs of the fork 71 by a pin 73. A middle portion of a lever 74 is fixed to an axle 75 which is rotatably supported in the base 12 so that the lever 74 is rotatable about the axis of the axle 75. A groove 76 is formed in the lower portion of the lever 74 for slidably receiving the block 72 so that the lever 74 can be caused to swing by the swinging movement of the lever 41. A link 77 is pivotally coupled between the upper end of the lever 74 and the rear end of the follower 56 so that the follower 56 can be caused to move back and forth by the swinging movement of the lever 74.

Figure 6:
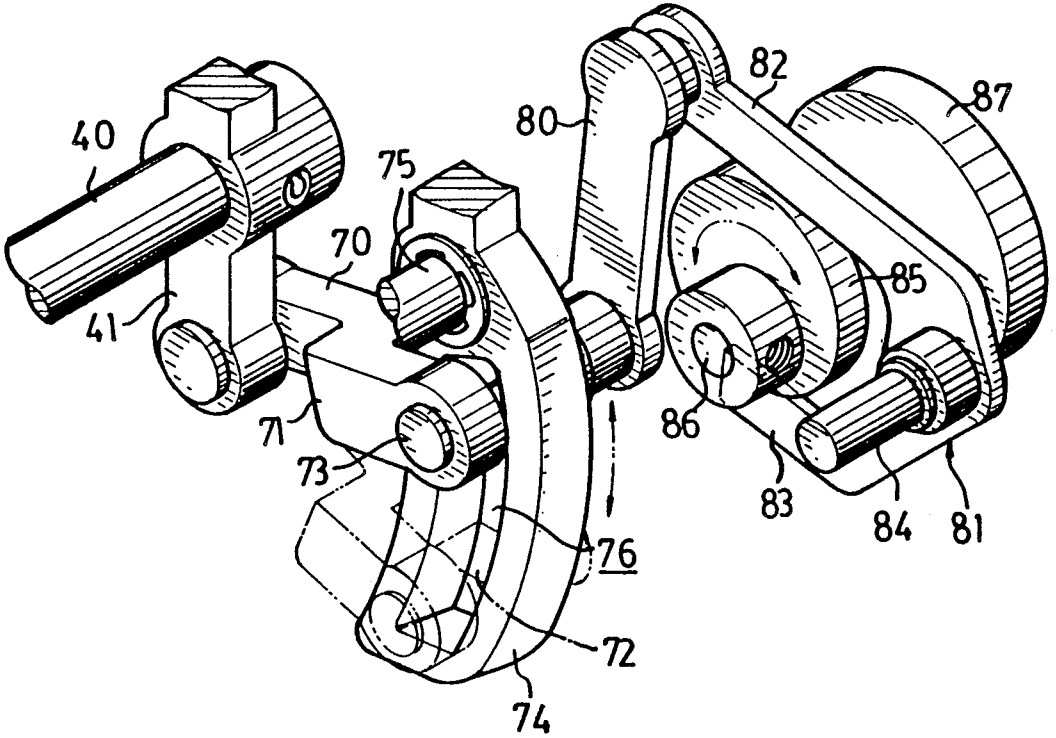
FIG. 6 is a perspective view illustrating an adjusting mechanism for adjusting the differential feeding of cloth.

A lower end of a link 80 is pivotally coupled on the pin 73. A substantially C-shaped follower 81 which includes two legs 82, 83 has a middle portion pivotally supported on a pin 84 which is fixed in the base 12. The front end of the upper leg 82 of the follower 81 is pivotally coupled to the upper end of the link 80. A cam 85 which is fixed on an axle 86 is received between the legs 82, 83 of the follower 81. The axle 86 is rotatably supported in the base 12 and has a knob 87 integrally fixed at the free end thereof. The knob 87 which is reachable from outside of the base 12 (FIG. 1) is provided for rotating the cam 85. As shown in FIG. 6, when the cam 85 rotates, the follower 82 and the link 80 are caused to move up and down so that the block 72 is caused to move up and down along the groove 76 of the lever 74 and so that the distance between the block 72 and the axle 75 can be adjusted.

Figure 8:
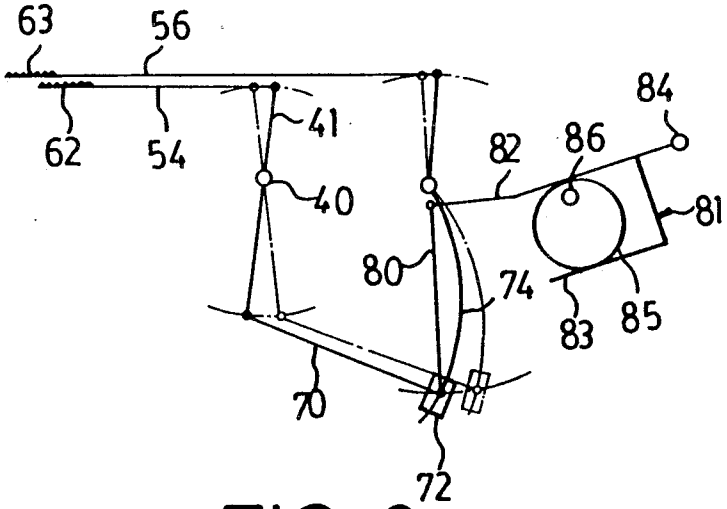
FIGS. 7 and 8 are schematic views illustrating the differential feeding operations.
Figure 7:
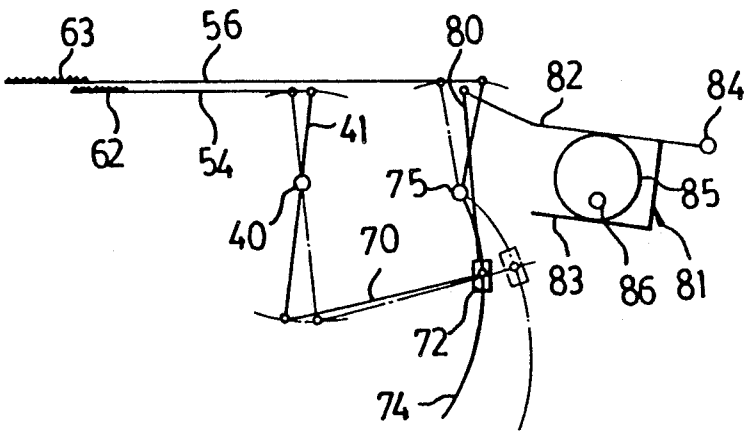

Referring next to FIGS. 7 and 8, the pawl 62 can be caused to move back and forth directly by the swinging movement of the lever 41, and the pawl 63 can be caused to move back and forth by the swinging movement of the lever 41 via the lever 74. As shown in FIG. 7, when the block 72 moves upward to an upper portion of the groove 76, the amplitude of the upper end of the lever 74 will be increased so that the pawl 63 will move further than the pawl 62 and so that the cloth retained by the pawls 62, 63 will be stretched or protracted by the pawls. On the contrary, as shown in FIG. 8, when the block 72 move downward to a lower portion of the groove 76, the amplitude of the upper end of the lever 74 will be decreased so that the pawl 63 moves shorter than that pawl 62 and so that a wrinkle portion will be formed in the cloth between the pawls 62, 63. The wrinkles can thus be automatically formed in the cloth without any manual operations.

It is to be noted that when the block 72 is located in the middle portion of the groove 76 of the lever 74, both of the pawls 62, 63 move in concert and have no relative movement formed therebetween, and can be caused to move back and forth by the swinging movement of the lever 41, so that the cloth can be fed forward by both of the pawls 62, 63. It is futher to be noted that the cloth can be fed by only one of the pawls 62, 63 if only one pawl 62 or 63 is mounted.

Accordingly, the differential feeding apparatus in accordance with the present invention can be provided to form wrinkles in cloth automatically and easily, and elastic articles can also be easily sewed without the manual stretching operations of the elastic articles.

It is to be noted that both knobs 37, 87 can be rotated during sewing operations; i.e., the knobs can be rotated when the spindle 20 and the shaft 40 are rotating. When the knob 37 is rotated, the inclination of the slot 31 can be changed so that the feeding stroke of both pawls 62, 63 can be adjusted during sewing operation, and when the knob 87 is rotated, the block 72 can be guided to slide along the groove 76 of the lever 74 so that the pawls 62, 63 can move relative to each other and so that cloth to be sewed can be fed differentially. The relative displacement between the pawls can also be adjusted during sewing operation.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A feeding apparatus for a sewing machine having a base for accommodating said feeding apparatus, said feeding apparatus comprising: a spindle and a shaft rotatably supported in parallel in said base; a first cam fixed on one end of said spindle and engaged in a first guide having a square outer shape, said first guide slidably received in a first rectangular opening of a first follower so that said first guide is movable along said first rectangular opening and so that said first follower is caused to move up and down by said first cam, a block pivotally coupled to one end of said first follower and slidably received in a slot formed in one end of a plate, a stub formed on said one end of said plate and pivotally supported in said base so that said plate is rotatable about said stub, the other end of said first follower pivotally coupled to one end of a first lever having a middle portion fixed to one end of said shaft so that said shaft is caused to swing by said first follower; a middle portion of a second lever fixed to the other end of said shaft; a second cam fixed on the other end of said spindle and engaged in a second guide which has a square outer shape, said second guide slidably received in a second rectangular opening of a second follower so that said second guide is movable along said second rectangular opening and so that said second follower is caused to move up and down by said second cam; a pawl fixed on one end of said second follower for feeding a cloth to be sewed; the other end of said second follower pivotally coupled to one end of said second lever so that said second follower is caused to move back and forth by rotation of said shaft; and so that said cloth is fed forward by said pawls; the other end of said plate pivotally coupled to a lower end of an arm, a ring portion integrally formed on an upper end of said arm for receiving a third cam fixed on an axle, said axle rotatably supported in said base, a knob fixed to one end of said axle and extending outside of said base; when said knob is rotated, said arm is caused to move up and down by said third cam so that said plate is caused to rotate about said stub and so that an inclination of said slot is changed, an amplitude of swinging of said first lever is chaged so that a feeding strokeof said pawl is adjusted.

2. A feeding apparatus for a sewing machine having a base for accommodating said feeding apparatus, said feeding apparatus comprising: a spindle and a shaft rotatably supported in parallel in said base; a first cam fixed on one end of said spindle and engaged in a first guide having a square outer shape, said first guide slidably received in a first rectangular opening of a first follower so that said first guide is movable along said first rectangular opening and so that said first follower is caused to move up and down by said first cam, a block pivotally coupled to one end of said first follower and slidably received in a slot formed in one end of a plate, a stub formed on said one end of said plate and pivotally supported in said base so that said plate is rotatable about said stub, the other end of said first follower pivotally coupled to one end of a first lever having a middle portion fixed to one end of said shaft so that said shaft can be caused to swing by said first follower; a middle portion of a second lever fixed to the other end of said shaft; a second cam fixed on the other end of said spindle and engaged in a second guide having a square outer shape, said second guide slidably received in a second rectangular opening of a second follower so that said second guide is movable along said second rectangular opening and so that said second follower is caused to move up and down by said cam; an annular flange integrally formed on one end of each of said first cam and said second cam, a ring fixed to the other end of each of said first cam and said second cam so that said first guide and said second guide are guided to slide along said first rectangular opening and said second rectangular opening respectively; a pawl fixed on one end of said second follower for feeding a cloth to be sewed; the other end of said second follower pivotally coupled to one end of said second lever so that said second follower is caused to move back and forth by rotation of said shaft; and so that said cloth can be fed forward by said pawl; the other end of said plate pivotally coupled to a lower end of an arm, a ring portion integrally formed on an upper end of said arm for receiving a third cam fixed on an axle, said axle rotatably supported in said base, a knob being fixed to one end of said axle and extending outside of said base; when said knob is rotated, said arm is caused to move up and down by said third cam so that said plate is caused to rotate about said stub and so that an inclination of said slot is changed, an amplitude of swinging of said first lever can be changed so that a feeding stroke of said pawl can be adjusted.

* * * * *